US010041768B2

(12) United States Patent
Staffin

(10) Patent No.: US 10,041,768 B2
(45) **Date of Patent: *Aug. 7, 2018**

(54) TEAR GAS ENHANCED FLUIDIZED BED SECURITY SYSTEM AND METHOD

(71) Applicant: Procedyne Corp., New Brunswick, NJ (US)

(72) Inventor: H. Kenneth Staffin, Colonia, NJ (US)

(73) Assignee: Procedyne Corp., New Brunswick, NJ (US)

( * ) Notice: Subject to any disclaimer, the term of this patent is extended or adjusted under 35 U.S.C. 154(b) by 3 days.

This patent is subject to a terminal disclaimer.

(21) Appl. No.: 15/421,771

(22) Filed: Feb. 1, 2017

(65) Prior Publication Data

US 2017/0356725 A1 Dec. 14, 2017

Related U.S. Application Data

(63) Continuation of application No. 14/276,559, filed on May 13, 2014, now Pat. No. 9,593,918.

(60) Provisional application No. 61/823,095, filed on May 14, 2013.

(51) Int. Cl.

| | |
|---|---|
| ***F41H 11/00*** | (2006.01) |
| ***F41H 9/04*** | (2006.01) |
| *F41H 13/00* | (2006.01) |

(52) U.S. Cl.

CPC ..... *F41H 9/04* (2013.01); *F41H 11/00* (2013.01); *F41H 13/00* (2013.01)

(58) Field of Classification Search

None

See application file for complete search history.

(56) References Cited

U.S. PATENT DOCUMENTS

| | | | | | |
|---|---|---|---|---|---|
| 1,000,910 | A | * | 8/1911 | Hoffler | F24C 15/023 126/191 |
| 1,306,488 | A | * | 6/1919 | Kuehn | E04D 1/22 52/529 |
| 1,331,018 | A | * | 2/1920 | Luthy | H01M 2/18 429/143 |
| 1,904,686 | A | * | 4/1933 | Humphreys | F24F 5/0046 261/103 |
| 2,003,320 | A | * | 6/1935 | Trainer | B23K 11/0053 219/101 |
| 2,956,565 | A | * | 10/1960 | Anderson | A01K 13/001 56/229 |
| 3,760,800 | A | * | 9/1973 | Staffin | A61H 33/04 601/17 |
| 3,965,827 | A | * | 6/1976 | Reeves | E05G 5/02 109/20 |

(Continued)

*Primary Examiner* — Michael David

(74) *Attorney, Agent, or Firm* — Stern & Schurin LLP

(57) ABSTRACT

A tear gas-based enhancement to a fluid bed security system implemented for the purpose of inhibiting unauthorized entry or access and to provide additional time for threatened individuals to evacuate or escape a hostile assembly at the perimeter of a secured area. The system provides for the reliable and controlled application of a specified concentration of tear gas emitted in conjunction with fluidizing gas distributed through a fluid bed configuration comprising a gas distribution piping array and a plurality of fluidizable granular solids in a surrounding relationship to the gas distribution piping array.

20 Claims, 11 Drawing Sheets

(56) References Cited

U.S. PATENT DOCUMENTS

| | | | | | |
|---|---|---|---|---|---|
| 4,202,471 | A * | 5/1980 | Fegley | B65D 83/267 | 222/153.11 |
| 4,214,576 | A * | 7/1980 | Henley | A61H 33/04 | 601/16 |
| 5,206,896 | A * | 4/1993 | Hargest | A61D 3/00 | 378/180 |
| 5,441,477 | A * | 8/1995 | Hargest | A61H 33/04 | 601/15 |
| 5,747,719 | A * | 5/1998 | Bottesch | G08B 13/19608 | 340/574 |
| 6,688,555 | B1 * | 2/2004 | Kneisl | B64D 45/0015 | 102/502 |
| 2003/0041768 | A1 * | 3/2003 | Rastegar | F41J 2/00 | 102/517 |
| 2003/0052226 | A1 * | 3/2003 | Allen | B64D 45/0015 | 244/118.5 |
| 2007/0007384 | A1 * | 1/2007 | Sliwa, Jr. | B64D 45/0015 | 244/30 |
| 2007/0008122 | A1 * | 1/2007 | Staffin | E01F 13/126 | 340/541 |
| 2014/0338517 | A1 * | 11/2014 | Staffin | F41H 9/04 | 89/1.11 |
| 2017/0045336 | A1 * | 2/2017 | Crowe | F41H 9/00 | |
| 2017/0356725 | A1 * | 12/2017 | Staffin | F41H 11/00 | |

* cited by examiner

TYPICAL LOOP SECTION

TYPICAL LOOP LOCATION

TEAR GAS ENHANCED FLUIDIZED BED SECURITY SYSTEM AND METHOD

RELATED APPLICATION

This application is a continuation of U.S. application Ser. No. 14/276,559, filed on May 13, 2014, now allowed, which claims priority to and the benefit of U.S. Provisional Application Ser. No. 61/823,095, filed on May 14, 2013. Both U.S. application Ser. No. 14/276,559 and U.S. Provisional Application Ser. No. 61/823,095 are incorporated herein by reference.

FIELD OF THE INVENTION

The present invention relates generally to a method and apparatus for increasing the security at sensitive locations such as plant sites, buildings, utility sites and military installations, and relates more specifically to an improved method and apparatus for increasing security utilizing fluidized granular solids. Even more specifically, the present invention involves a defensive enhancement to a security system and method utilizing tear gas.

BACKGROUND OF THE INVENTION

The enhancement of security at sensitive locations has always been a concern throughout modern history. At the present time, methods of limiting, controlling, and/or monitoring access of vehicles and personnel to buildings and sites typically include fences, access gates, guardhouses, barricades and related obstacles. Commercially available solutions also include sliding gates, drop bars, bollards, anti-ram walls, hydraulic wedges, hydraulic rising beams, retractable bollards, tire shredders, and ditches.

When a situation involves the potential of forced entry or secret unauthorized entry by personnel on foot or inside vehicles, particularly when aggressive unauthorized entry is involved, the typical approach involved armed personnel, impenetrable fences or gates and/or barricades. This approach has proven to be inadequate in many situations such as those involving people and vehicles both of which may be equipped with explosives.

Other drawbacks of the aforementioned means employed to address these situations involve the inability to assess, or the faulty assessments of, the intention underlying an intrusion. By the same token, miscommunications also tend to promote uncertainty. As a result of these problems, personal injury and/or significant damage to vehicles can easily result in unwanted fatalities and costly material loss.

Solutions to many of the security concerns and problems raised above have been disclosed in PCT/US2006/026495, U.S. Pat. No. 7,405,654 and U.S. Pat. No. 7,760,087, the disclosures of which are incorporated herein by reference. Despite their inherent advantages, the systems and methods disclosed in these references are predominantly effective in specific situations and against specified forms of aggressors and attacks, such as for the protection of an embassy or building from an approaching vehicle or individual carrying explosives, where the explosion and damage are generally intended to be inflicted more swiftly and with greater force and immediate impact. By comparison, in large demonstrations or hostile attacks involving many people and which may commence peacefully but develop and escalate gradually, a fluidized bed alone may be an insufficient defensive measure to protect a given area or building and the individuals within. Once the bed is fluidized, individuals outside the effective fluidized area may avoid or circumvent the proscribed and affected area and seek alternate means to breach the perimeter defenses.

Accordingly, there remains a need to maintain or control perceived hostile situations involving less lethal or non-lethal, yet aggressive congregations of individuals. By the same token, once the affirmative lethal intent of a mob is determined, there remains a significant need to delay the actions of its constituents until help arrives or to enable escape of those who are threatened. In view of the foregoing, there is a need to effectively guard against and disperse hostile groupings of individuals and aggressive demonstrators in a non-lethal manner which promotes the dispersion of these individuals prior to the escalation of an event taking place, for example, outside a government building or on the perimeter of a secured or guarded location.

Generally, various types of tear gas have been utilized by governments and policing agencies and organizations to disperse or quell riots and hostile assemblies of individuals. One of the most notable tear gas compounds is 2-chlorobenzalmalononitride ($C_{10}H_5ClN_2$) termed "CS." This compound is most frequently used due to its strong effect and exhibiting the least toxicity in comparison with other similar chemical agents. However, despite its advantages, establishing a uniform, appropriately concentrated delivery of CS gas to a crowd demonstrating in a given area is difficult because CS is a solid at room temperature, not a gas.

In the prior art, a variety of approaches have been used to make the CS solid serviceable as a gas, including, but not limited to, dissolving the CS solid in an organic solvent and delivering the combination as an aerosol; heating the CS solid in a thermal grenade by generating hot gases to evaporate the CS; melting and spraying CS in its liquid form; and other ways known in the art. However, none of these methods have achieved a reliable or consistently controllable concentration when utilized in amidst a crowd.

SUMMARY OF THE INVENTION

In view of the deficiencies and drawbacks in the prior art, it is a primary object of the present invention to provide a tear gas enhanced fluidized bed security system and method which supplies tear gas to an area in order to effectively disperse hostile or otherwise aggressive individuals assembling at or around a building or on the perimeter of guarded location.

It is another object of the present invention to provide a tear gas enhanced fluidized bed security system and method which delivers tear gas in a reliable, uniform and desirable concentration to effectively disperse hostile or otherwise aggressive individuals without causing long-term physical damage as a result.

It is a further object of the present invention to provide a tear gas enhanced fluidized bed security system and method which distributes tear gas utilizing the same gas (e.g., air) that results in fluidization of the fluidized bed.

It is yet another object of the present invention to provide a tear gas enhanced fluidized bed security system and method which provides additional time to inhabitants of a building or secured area to receive assistance, mobilize and/or escape the threat from a hostile assembly in the vicinity.

Another object of the present invention is to provide a reliable, concentration-controlled tear gas delivery system.

Additional objectives will be apparent from the description of the invention that follows.

The present invention provides a tear gas-based enhancement to a security system implemented for the purpose of inhibiting unauthorized entry or access by a third party to a location. At the core of the invention, the system provides for the reliable and controlled application of a specified concentration of tear gas emitted in conjunction with gas (e.g., air) blown through a bed of fluidized granules (e.g., silicon sand, beach sand) of approximately 60 mesh.

In a preferred embodiment, a tear gas enhanced security system is implemented by creating the fluid bed security apparatus according to the principles and disclosure set forth in PC/US2006/026495, U.S. Pat. Nos. 7,405,654 and 7,760,087. In that regard, a substantially planar defined surface area is selected, beneath which, one or more first enclosures are disposed. Preferably, each first enclosure comprises a retaining structure along the open perimeter of each first enclosure to inhibit collapse. At least a majority of each first enclosure is disposed below the defined surface area. In a preferred embodiment, the open perimeter of the first enclosure is substantially flush to the surface of the defined surface area.

Within each first enclosure, a fluid bed configuration is placed, said configuration preferably including a gas distribution piping array and a plurality of fluidizable granular solids in a surrounding relationship to the gas distribution piping array having gas injection nozzles that are fluidly connected to the gas distribution piping array. Other means for delivering fluidizing gas to the fluidizable granular solids may also be utilized. An air blower, gas fluidizer or other fluidizing gas means is fluidly connected to the gas distribution piping array to provide a fluidizing gas (e.g., air).

In a preferred embodiment, operatively and fluidly attached to the gas distribution line(s) is a solution of CS tear gas comprised of CS and a methylene chloride solvent. The CS tear gas solution is fed at a reliably controlled concentration and rate to mix with the fluidizing gas. The construction of the fluid bed configuration allows the CS tear gas to distribute among the fluidized particles and pass through the top surface thereof. As the gas exits, it spreads out over the large area above and around the fluidized bed to neutralize individuals in the vicinity.

Moreover, a tear-gas enhanced fluidized bed security apparatus may also be utilized in connection with a method for inhibiting movement by one or more unauthorized third parties at a location. Thus, in addition to providing a fluid bed configuration disposed in a first enclosure disposed in the defined surface area set up with a tear gas delivery module as set forth above, a sensor or detector may be provided to detect the presence of one or more unauthorized third party. Once the sensor is triggered, the fluidized bed is set off and tear gas enhanced fluidization of the fluid bed commences. This not only inhibits coordinated and unauthorized movement, but also clouds the immediate vicinity and impairs vision of individuals not trapped in the fluid bed but sufficiently close to be affected by tear gas. Fluidization and distribution of the tear gas may be continued until the threat is neutralized.

Advantageously, the present invention provides a tear gas enhanced security system as well as tear gas enhanced methods for impairing vision and inhibiting coordinated movement of unwanted third parties while also still avoiding the use of potentially lethal force common with security measures currently in use at sensitive locations.

The invention also provides a means to delay unauthorized entry into a secure area, thus providing additional precious time for inhabitants of a secured building or area to escape. As a result, personal injury, loss of life and material loss are minimized. These and other advantages of the present invention will become more apparent to those skilled in the art from the description set forth below.

BRIEF DESCRIPTION OF THE DRAWINGS

The above-described and other advantages and features of the present disclosure will be appreciated and understood by those skilled in the art from the following detailed description and drawings of which

DETAILED DESCRIPTION OF THE INVENTION

Figure 1A:
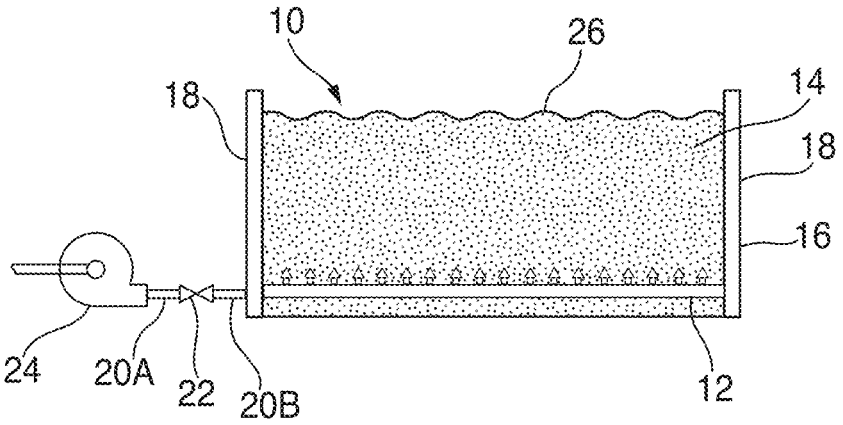
FIG. 1A is a cross-sectional view of a fluid bed configuration in a defluidized state.

The present invention provides a tear gas enhanced fluid bed security system and accompanying methods for inhibiting unauthorized movement and/or providing additional time to evacuate a secured location from where ingress or egress is restricted.

In a preferred embodiment of the present invention, a tear gas enhancement may be applied to an existing or new fluidized security bed apparatus constructed in accordance with the disclosures and teachings set forth in PCT/US2006/026495, U.S. Pat. No. 7,405,654 and U.S. Pat. No. 7,760,087 which are incorporated herein by reference.

The security system provides a first enclosure disposed in a defined surface area extending from a location for movement of personnel to and from the location. A fluidized bed configuration is disposed in the first enclosure. Under normal conditions, the fluidized bed within the defined surface area is maintained in a defluidized state allowing personnel to traverse an open perimeter of the first enclosure that is disposed in the defined surface area. If suspicious behavior is detected, a fluidizing gas means or air blower is activated causing gas (e.g., air) to be fed to a gas distribution piping array within the fluid bed configuration to fluidize the granular solids. Fluidization of the granular solids typically occurs in a matter of seconds. As a result of fluidization, a third party individual or vehicle traversing the open perimeter of the first enclosure sinks into the fluidized bed and becomes at least partially submerged. The granular solids are thereafter defluidized resulting in the third party being immobilized in the bed of granular solids.

In accordance with the invention, personnel are defined as anyone or anything that can move to or from a location along a defined surface area. Representative examples of personnel include, but are not limited to, an individual, a group of individuals, a vehicle or a group of vehicles, animals, or any mobile device. Vehicles in this context can be either remotely-operated or manually-operated.

A third party is any personnel whose movement to or from a location should be potentially restricted. Representative examples of third parties to be restricted from a location include, but are not limited to, terrorists, car bombs, truck bombs, suicide bombers, rioters, prisoners, protestors, foreign soldiers and any combination thereof.

A location is any site into which or from which personnel seek ingress or egress. Representative examples of a location include, but are not limited to, buildings, government facilities, military facilities, correctional facilities, commercial processing facilities, energy generating facilities, water reservoirs, medical facilities, airports, or dams.

A defined surface area is any two-dimensional surface defined by a boundary used by personnel to move to or from a location. In a preferred embodiment, a defined surface area is a roadway, a pathway, a walkway or any other means used for movement or travel by personnel to or from a location. Representative examples of a defined surface area include, but are not limited to, areas inside or outside buildings, areas surrounding facilities such as prisons, at the end of airport runways or runaway truck ramps on major highways. The defined surface area can be substantially planar, substantially inclined, substantially elevated or any combination thereof. Preferably, the defined surface area is substantially planar.

Referring now to the drawings, FIG. 1A is a cross-sectional view of a fluid bed configuration 10 disposed in a first enclosure 18. Fluid bed configuration 10 includes gas distribution piping array 12 and plurality of fluidizable granular solids 14 in a surrounding relationship to gas distribution piping array 12. First enclosure 18 has an open perimeter 26 substantially parallel and proximal to a defined surface area (not shown) adapted for movement of personnel to or from a location. A majority of first enclosure 18 is disposed below the defined surface area. The perimeter 26 of first enclosure 18 is preferably substantially flush to the surface of the defined surface area.

As shown in FIG. 1A, first enclosure 18 is shown as a rectangular configuration. However, other geometric configurations can be used. Granular solids 14 are disposed in first enclosure 18 and are shown in a defluidized state. Gas distribution piping array 12 having gas injection nozzles 16 attached thereto is disposed in fluidizable granular solids. Preferably, as shown in FIG. 1A, fluidizing gas means 24 is fluidly connected to gas distribution piping array 12 and introduces gas, such as air, into gas distribution piping array 12 through discharge and inlet pipes 20A, 20B, respectively. Fluidizing gas means 24 can be any means of generating and transferring a flow of gas into gas distribution piping array 12. Representative examples of a fluidizing gas means include, but are not limited to, an air compressor, a pressurized gas tank, a blower or any combination thereof. Preferably, gas distribution piping array 12 is provided with a control valve 22 that regulates the flow of gas into the array. In one preferred embodiment, fluidizing gas is maintained in a pressurized tank fluidly connected to an air compressor. For example, a compressor having at least 5 horsepower (HP) can used in standby to assure that the tank is maintained at full capacity. In a tear gas enhanced system, a CS tear gas solution may be mixed into the line for delivery into the fluid bed via the gas array. If there is a desire to keep the fluidizing gas pipes free clear from CS tear gas, it should be appreciated that a separate line and piping array may be used to deliver tear gas infused fluidizing air.

Figure 1B:
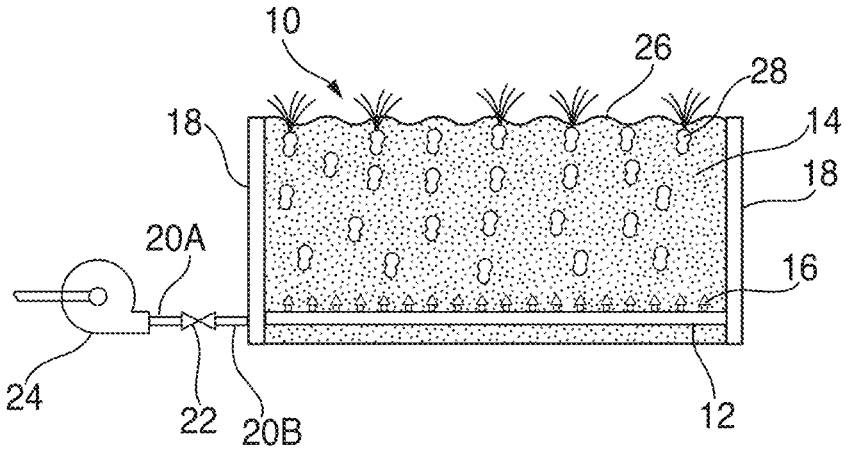
FIG. 1B is a cross-sectional view of a fluid bed configuration in a fluidized state.

FIG. 1B is a cross-sectional view of fluid bed configuration 10 (shown in FIG. 1A) in a fluidized state. When granular solids 14 of the fluid bed configuration are fluidized, separation of granular solids 14 occurs. When the flow is increased sufficiently, void spaces 28, also termed pseudo bubbles, are formed in the fluidized medium where they rise to the surface and release the gas pocket. In a tear gas enhanced system, void space 28 may also carry tear gas to the surface for dispersion.

Figure 2:
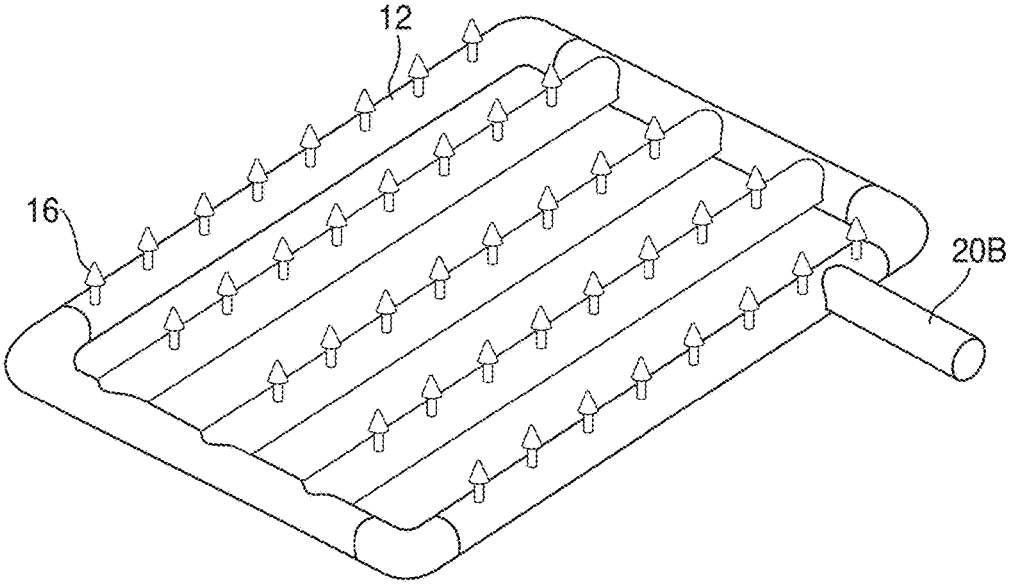
FIG. 2 is a perspective view of an air piping array configuration used in accordance with the present invention.

FIG. 2 is a perspective view of gas distribution piping array 12. However, as will be apparent to those skilled in the art, other gas distribution piping array configurations can also be used. Gas injection nozzles 16, also termed tuyeres, have the ability of uniformly distributing a gas flow vertically into fluidizable granular solids 14 (not shown) while preventing granular solids 14 from flowing into gas distribution piping array 12. Gas injection nozzles 16 are spaced apart along gas distribution piping array 12. In one preferred embodiment, gas injection nozzles 16 are uniformly spaced apart, such as 4 to 8 inches apart. In a tear gas enhanced system, alternate piping arrays may be utilized to deliver tear gas alone or in combination with piping arrays and configuration used to deliver the fluidizing gas.

Figure 3:
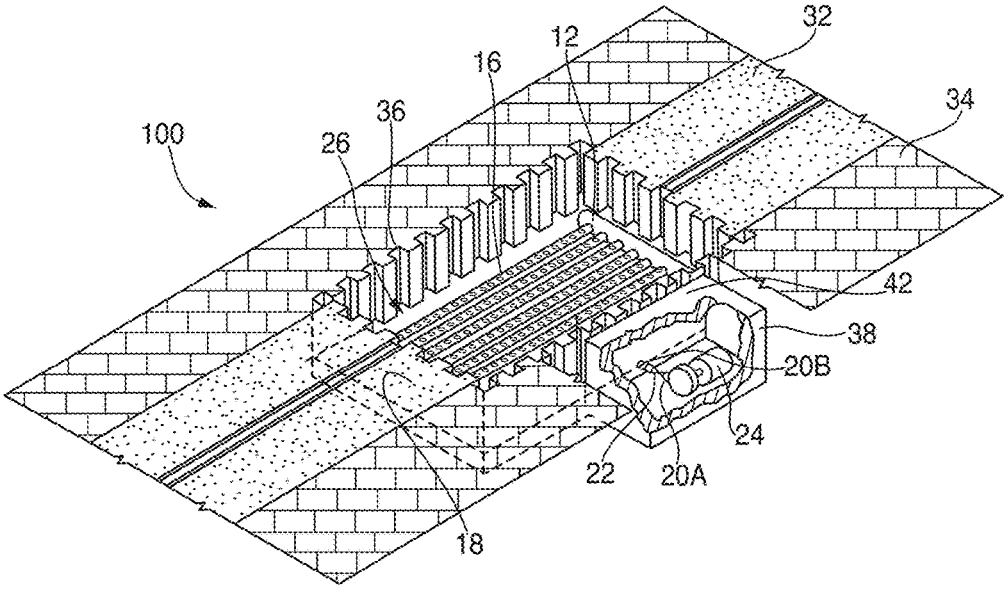
FIG. 3 is a perspective view of a roadway adapted with a fluid bed configuration.

FIG. 3 is a perspective view of a preferred embodiment depicting the security system of the invention. As shown in FIG. 3, security system 100 includes a defined surface area (shown as roadway 32) provided with first enclosure 18. First enclosure 18 is disposed in the earth below roadway 32 extending from a location (not shown). Fluid bed configuration 10 is disposed in first enclosure 18. First enclosure 18 has an open perimeter 26 substantially parallel and proximal to a defined surface area (shown as roadway 32) and a majority of first enclosure 18 is disposed below the defined surface area. In a preferred embodiment, first enclosure 18 is sufficiently wide to extend the width of roadway 32 and roadway shoulder 34. The length of first enclosure 18 depends upon the details of the particular security objective involved. For example, the length of the first enclosure 18 will be greater if the third party travels at higher speed such as a truck or car as compared to a pedestrian. As shown in FIG. 3, retaining structure 36 is, preferably, disposed along the perimeter walls of first enclosure 18 to inhibit collapse of the earth of the excavation in which first enclosure 18 is formed. Retaining structure 36 can be any material of construction suitable for the purpose of inhibiting the collapse the earth surrounding of enclosure 18. Representative examples include, but are not limited to, corrugated steel, fiberglass, ceramic block, wood panels, wood timbers or poured concrete.

FIG. 3 also depicts a second enclosure 38 provided for housing fluidizing gas means 24. As depicted in FIG. 3, second enclosure 38 is adjacent to first enclosure 18. However, second enclosure 38 does not have to be located adjacent to first enclosure 18 and can be placed wherever feasible. Discharge pipe 20A exiting from fluidizing gas means 24 is fluidly connected to control valve 22 which in turn is fluidly connected to inlet pipe 20B. Control valve 22 allows for the adjusting of the flow of gas from fluidizing gas means 24 to distribution piping array 12 to achieve proper fluidization. Retaining structure 36 is disposed along the perimeter wall of second enclosure 38 to inhibit collapse of a defined surface area. Second enclosure 38 has a cubic volume preferably less than first enclosure 18. Second enclosure 38 is preferably adapted with removable cover 42. Removable cover 42 can be removed for periodic maintenance of fluidizing gas means 24. Removable cover 42 is designed and fabricated to be sufficiently strong enough to withstand the weight of personnel traversing the defined surface area and to give the appearance that removable cover 42 is part of the defined surface area. It should be appreciated that in a tear gas enhanced system, second enclosure may be modified to accommodate the appropriate materials and hardware (discussed below) used to generate and disperse tear gas via the piping array into the fluidized bed.

In accordance with the present invention, granular solids 14 preferably measure from about 40 to 100 US Mesh particle size, and more preferably from about 60 to 80 US Mesh particle size. As will be apparent to those of ordinary skill in the art, a variety of granular solids having different granular particle types, shapes, compositions or densities can also be used. In accordance with the invention, granular solids 14 are disposed in first enclosure 18 until the top surface of the bed is substantially parallel to the defined surface area.

Figure 4A:
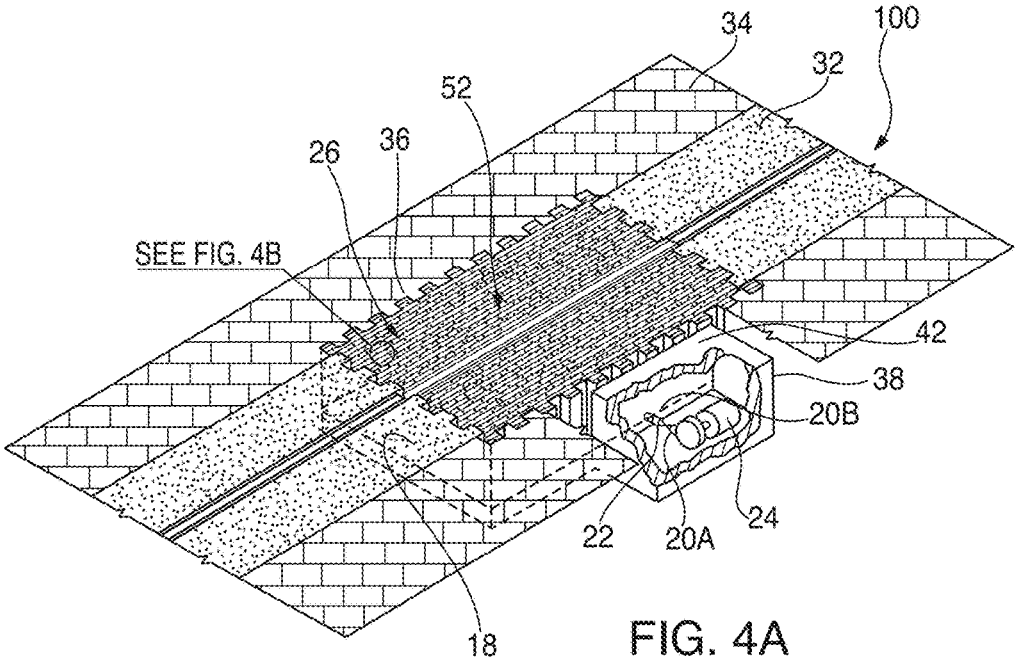
FIG. 4A is a perspective view of preferred embodiment of the security system of the present invention.

In a preferred embodiment, as shown in FIG. 4, open perimeter 26 includes open support structure 52 (e.g., an open grating) that is disposed on the plurality of fluidizable granular solids 14. Preferably, open support structure 52 is disposed substantially flush with the surface of roadway 32 such that it provides stability for personnel traversing the surface of roadway 32. However, support structure 52 can also be disposed slightly above or below the surface of roadway 32. If support structure 52 is not provided, when personnel, such as in a vehicle, travels on roadway 32 and traverses open perimeter 26 that encompasses the defluidized bed of granular solids 14, the vehicle may exhibit sluggish driving characteristics typically experienced while driving on sand, such as a beach. Support structure 52 is provided to assist in lessening, and preferably eliminating, the potentially sluggish behavior exhibited by traversing a defluidized bed of granular solids 14. Likewise, support structure 52 improves the condition of the surface of the defluidized bed of granular solids 14 for normal personnel traffic. Support structure 52 is supported by the defluidized bed of granular solids configuration, as shown in FIG. 4. Support structure 52 can be constructed of any material capable of withstanding the weight of personnel movement above it and has sufficient openings to provide open surface area to allow it to sink in the bed when the bed becomes fluidized. Preferably, support structure 52 is made of metal or metal alloy. More preferably, support structure 52 is a steel grating. Typically, a steel grating with an open surface area of from about 40% to 70% is used. In accordance with the present invention, a support structure open area is defined as the percent (%) horizontal area that is not blocked by the structural members comprising the support structure. In an alternative embodiment, a metal or metal alloy support structure having a sheet configuration with an open surface area of from perforations of about 40% to 70% disposed therein can be used.

Figure 4B:
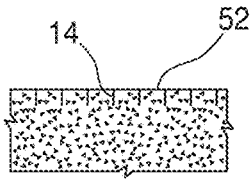
FIG. 4B is cross-sectional view of the support structure depicted in FIG. 4A.

Support structure 52 is preferably defined by a perimeter smaller than open perimeter 26 of first enclosure 18 so that the fluidization of the medium causes support structure 52 to fall into fluidized bed of granular solids 14 as personnel become submerged in fluidized bed of granular solids 14. Preferably, support structure 52 is adapted to fall at a rate equal to or greater than personnel traversing the granular solids 14 when fluidized. A cross-sectional view of support structure 52 is provided in FIG. 4B. As shown in FIG. 4B, a portion of support structure 52 can be partially disposed in the granular solids 14.

Figure 5A:
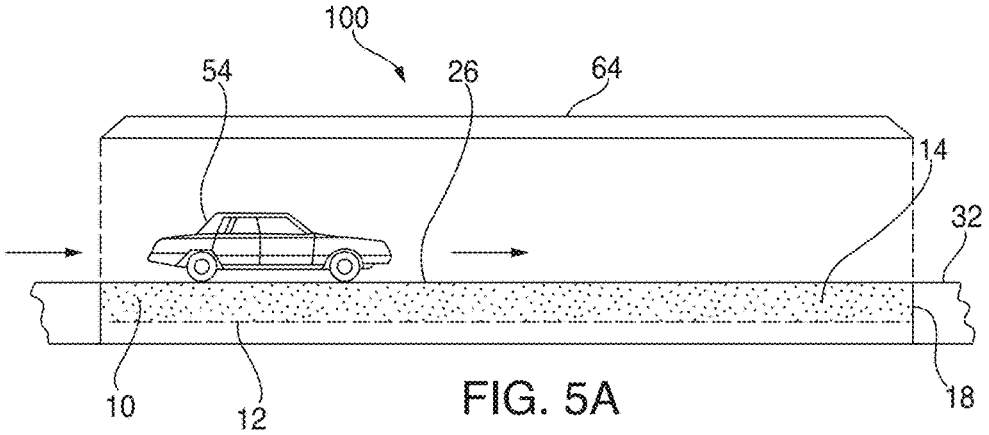
FIG. 5A is a side view of the security system in a section of roadway with the fluid bed configuration in a defluidized state.
Figure 5B:
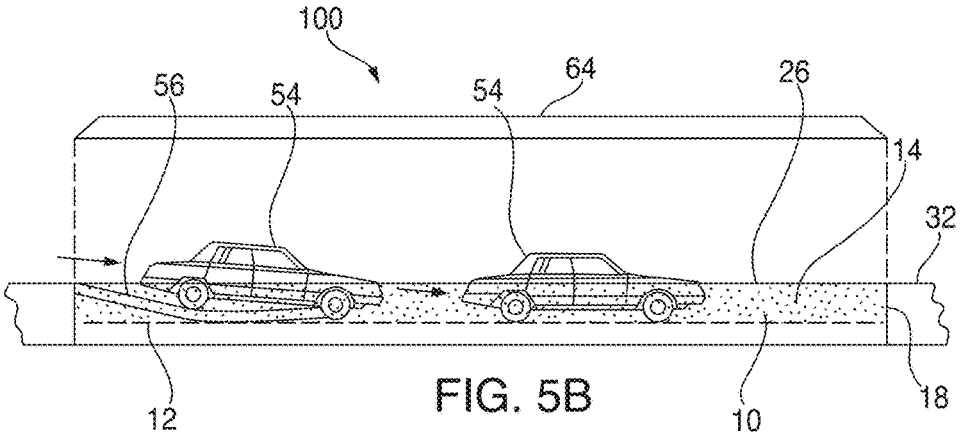
FIG. 5B is a side view of the security system in a section of roadway with the fluid bed configuration in a fluidized state.

FIG. 5A is a side view of a preferred embodiment of security system 100 for inhibiting unauthorized entry of a third party installed in a roadway. FIG. 5A depicts vehicle 54 proceeding at a normal speed along roadway 32 with no incident when granular solids 14 are in a defluidized state. However, as shown in FIG. 5B, when a suspicious vehicle approaches the area by either failing to slow down, speeding up or failing to obey instructions or signals from an assigned person such as a security guard, the defluidized bed of granular solids 14 of roadway 32 is be fluidized via piping array 12 upon activation of fluidizing gas means 24 (not shown). In a preferred embodiment, the bed is fluidized in less than 5 seconds, with less than 3 seconds being more preferred.

For example, when a signal is given by installed sensors or by the observation of a guard, gas means 24 is activated to fluidize granular solids 14 via piping array 12. Upon entering open perimeter 26, vehicle 54 will veer downward and enter the liquid-like medium created by fluidized granular solids 14. Entry of vehicle 54 into the fluidized medium will cause vehicle 54 to decelerate and eventually stop. Generally, vehicle 54 will become submerged to a level that prevents the doors of the vehicle from being easily opened. Preferably, vehicle 54 is submerged in the bed to a level just above the door panels and about several inches on to the door windows. Fluidizing gas means 24 is thereafter deactivated so that the bed of granular solids 14 is defluidized and returned to the original state. Preferably, the bed defluidizes in less than 8 seconds, with less than 6 seconds being preferred. The defluidization of the granular solids 14 traps vehicle 54 and its occupants in place because the doors cannot be fully opened when vehicle 54 becomes at partially buried in the bed to a sufficient depth. In a preferred embodiment, vehicle 54 is removed from the bed manually. In yet another preferred embodiment, vehicle 54 is removed from bed of granular solids 14 with proper lifting equipment by reactivating gas means 24 and refluidizing the bed. As used herein, proper lifting equipment can include, but is not limited to, two or more lifting straps submerged within bed of granular solids 14. The lifting straps can be connected to a hoist positioned above vehicle 54. Bed of granular solids 14 is fluidized and vehicle 54 can be removed by hoisting it up and out of the bed using the lifting straps. Fluidizing the bed after the lifting straps are in place reduces the lifting capacity needed to remove the vehicle from the bed.

The choice of fluidizing medium and its properties for granular solids 14 will determine the extent of the viscosity and density of the medium. As a result, the selection of granular solids 14 will affect the rate of deceleration and thus deceleration can be adjusted within a range to avoid extensive damage to the vehicle and its occupants. Another parameter to be considered is the size of fluidized bed configuration 10 to be provided within the defined surface area, which should be calculated when determining the size of the excavation. These parameters can easily be ascertained by one of ordinary skilled in the art following the teachings of the present invention.

In a preferred embodiment of the present invention, as shown in FIG. 5B, guiding structure 56 is disposed in the plurality of fluidizable granular solids 14 to control the descent of vehicle 54 upon entering fluidized bed 10 of security system 100. Preferably, guiding structure 56 is submerged in the bed of granular solids 14 at a position adjacent to the point of transition from roadway 32 to open perimeter 26. Guiding structure 56 preferably provided in the geometric shape of a ramp to act as a wheel guide for vehicle 54. Guiding structure 56 at least partially controls the path of vehicle 54 when it initially enters the bed of granular solids 14. Referring to FIG. 5B, guiding structure 56 is also preferably provided to facilitate the angle of penetration into granular solids 14 and the side to side movement of vehicle 54. Guiding structure 56 is preferably fabricated from metal such as perforated metal. Preferably, the perforated metal has at least 60% open area so its presence does not degrade the fluidization characteristics of fluid bed 10.

Figure 6A:
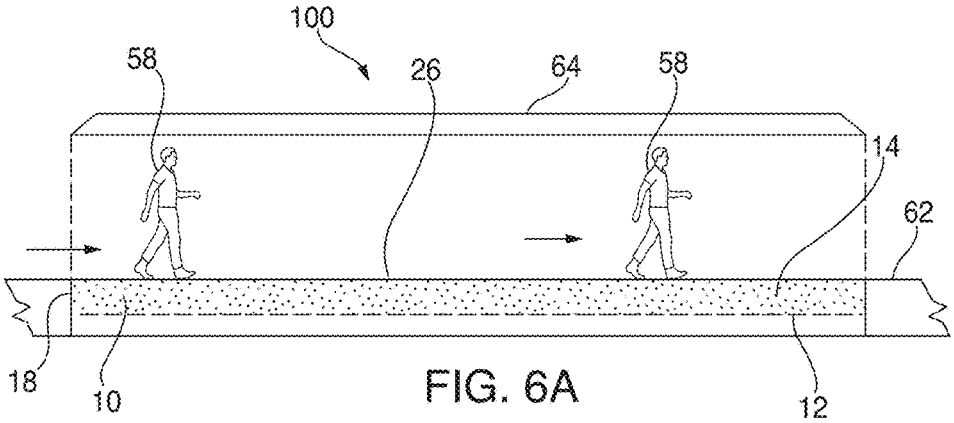
FIG. 6A is a side view of the security system in a section of walkway with the fluid bed configuration in a defluidized state.

In another preferred embodiment as shown in the side view depicted in FIG. 6A, security system 100 for inhibiting unauthorized entry of a third party is installed in a walkway. First enclosure 18 is disposed in walkway 62 extending from a location (not shown). Disposed in first enclosure 18 is fluid bed configuration 10 that includes piping array 12 surrounded by granular solids 14. Piping array 12 is fluidly connected to fluidizing gas means 24 (not shown). First enclosure 18 has an open perimeter 26 substantially parallel and proximal to the defined surface area (shown as walkway 62). Open perimeter 26 allows movement of personnel 58 to or from the location when granular solids 14 are in a defluidized state. Preferably, open perimeter 26 of walkway 62 is at least about 6 to 10 feet in width, at least about 10 to 15 feet in length while first enclosure 18 has a depth of at least about 2 to 5 feet.

Figure 6B:
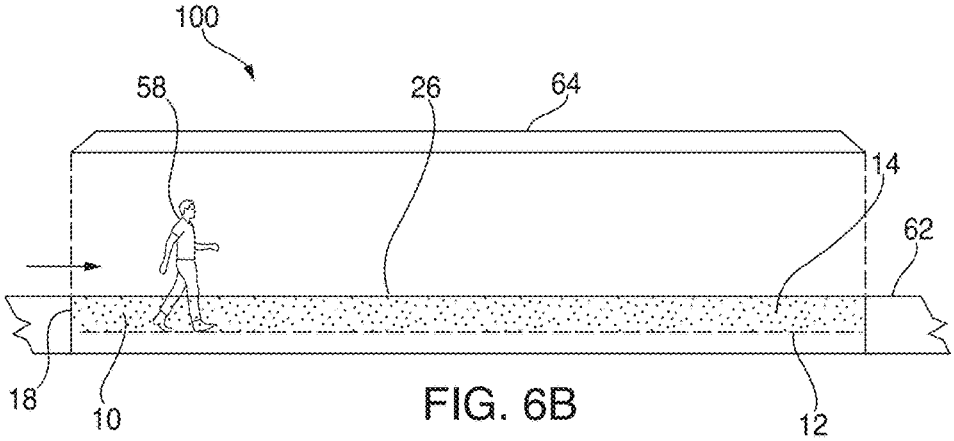
FIG. 6B is a side view of the security system in a section of walkway with the fluid bed configuration in a fluidized state.

Personnel 58 are able to traverse walkway 62 without difficulty as shown in FIG. 6A. However, when personnel moving along the walkway are suspected of attempting an unauthorized ingress or egress, fluidization of granular solids 14 disposed in walkway 62 is activated. As shown in FIG. 6B, personnel 58 sink into granular solids 14 and become at least partially submerged. Preferably, fluidization of granular solids 14 and partial submergence of personnel 58 occurs in less than 4 seconds, with less than 2 seconds being more preferred. The fluidized density to achieve optimum submergence performance of a vehicle or person in the medium ranges preferably from about 60 lbs. per cubic feet to 120 lbs. per cubic feet.

In still another preferred embodiment, to protect bed of granular solids 14 in both roadway 32 and walkway 62, shield 64 is located above open perimeter 26 as shown in FIGS. 5A, 5B, 6A and 6B. Shield 64 is designed to protect granular solids 14 within open perimeter 26 from environmental elements. Representative examples of environmental elements include, but are not limited to, rain, snow or wind that could wet down the bed of particles and possibly cause a change in the properties of the fluidized medium.

The properties of the bed of granular particles such as the pseudo viscosity, fluidized bulk density, minimum fluidization velocity and pseudo hydraulic behavior are determined by the physical properties of the granular solids including particle density, particle shape, particle size, and particle size distribution, and the physical properties of the fluidizing gas including density, viscosity and fluidization velocity. In accordance with the present invention, the properties of the granular solids and the fluidizing velocity of the gas phase can be easily selected to achieve the needs of the particular security application. The determination of these properties is well within the ability of those of ordinary skill in the art following the teachings of the invention.

Figure 7:
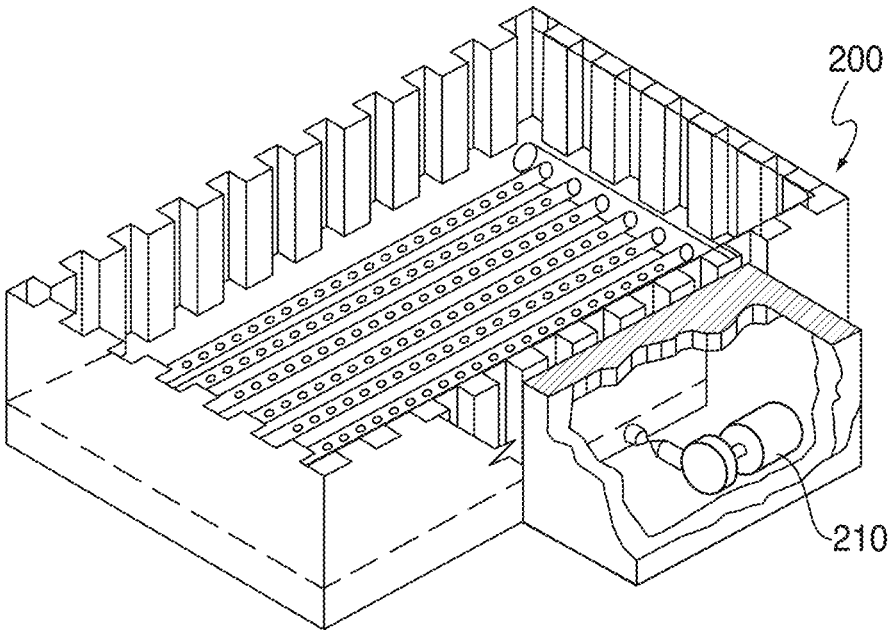
FIG. 7 is a fluidized bed moat module constructed in accordance with the present invention.
Figure 8:
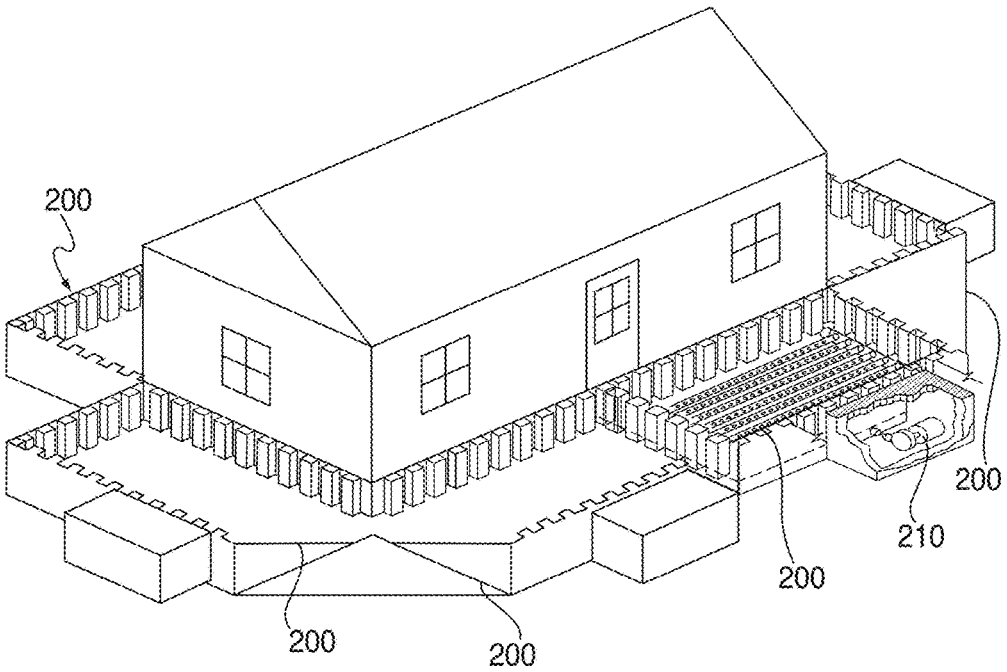
FIG. 8 is a perspective view of an arrangement of a series of fluid bed moat modules around a building.

Referring to FIG. 7 and FIG. 8 is a fluid bed moat module 200 and an arrangement of a series of fluid bed moat modules around a building, the intended purpose of which is to create a "moat." One of the goals of the fluid bed moat module 200 is to provide a modular fluid bed system, with a tear gas enhancement option, that can be utilized in multiple arrangements to protect the walls or perimeters of important buildings and secured areas, regardless of the geometric shape or structure. In conjunction with the disclosure above, each fluid bed moat module 200 is installed in excavated ground adjacent to the building or area to be protected. A typical module has outer dimensions of approximately 20 ft. by 50 ft. (e.g., approximately 6 meters by 15 meters) and is installed in an excavation approximately 6 feet deep (e.g., 1.83 meters) forming the rectangular volume of the fluid bed system.

An array of plastic piping 12, such as depicted in FIG. 2, feeds fluidizing air uniformly into the bed of fluidizing sand which is used to fill the excavation of the fluid bed moat module 200 to the top of the rectangular container. The fluidizing air is supplied from a horizontal 18,000 gallon tank which is pressurized to 250 psi with air by a small 250 psig compressor and a large volume 300 HP 6 psi compressor.

The purpose of the tank with 250 psig air is to assure that if an intrusion signal is activated, there is sufficient high pressure air to fluidize the unfluidized bed in less than 3 seconds. After approximately 15 seconds of fluidization from the high pressure tank, the low pressure higher volume compressor takes over the fluidization and can continue for extended periods of time as needed. This high flow 6 psig compressor has the capacity to maintain fluidization as long as required with the high pressure compressor turned off. This combination of high and low pressure blowers provides for an immediate fluidization in under 3 seconds and the subsequent requirements for steady state fluidization as the tank pressure drops to approximately 6 psig and the tank valve is closed. This fluidization stage can then be maintained for as long as needed. The intruding vehicle is typically submerged and stopped within one to two seconds. If the intruding vehicle is a car, or small truck or motorcycle, the fluidization air would be stopped in less than one or two seconds to trap the occupants.

Notably, air supply tanks 210 are not shown for each fluidized bed moat module 200. Furthermore, it is typically not necessary for each fluidized bed moat module 200 to be equipped with its own air supply tank 210. Thus, when a building or secured area is being protected by many fluidized bed moat modules 200, the system requirements initiate air flow can be met with a fewer number of air supply tanks 210 than modules 200 because one tank 210 can service more than one module 200.

In many preferred embodiments, the fluidization period lasts for two or more minutes depending on the total available supply. At the conclusion of fluidization period, a valve in the air supply tank 210 closes and the air compressor may take up to sixty (60) minutes (and sometimes more) to re-pressurize the tank 210 to re-establish the security system.

Table 1 lists parameters for a preferred embodiment of a fluidized bed moat module. These parameters are typical of a security moat to protect a specific building against intrusion. Notably, the parameters may be altered as needed in accordance with the present invention to suit other building configurations or forms of intrusion. By the same token, the parameters below may be utilized in connection with a tear gas enhanced fluid bed module or other fluid bed based security system.

TABLE 1

| | | |
|---|---|---|
| Fluid Bed Intrusion Area: | 1000 | $ft^2$ |
| Fluid Bed Depth | 5 | ft |
| Fluidization Velocity | 20 | fT/min |
| WT. of Un-fluidized Sand | 250 | tons |
| Density of Fluidized Sand | 90 | $lbs/ft^3$ |
| Wt. of Fluidized Sand | 225 | tons |
| Sand Mesh Approx. | 80 | mesh |
| Bed dP | 3.1 | psi |
| Fluidizing Gas Distributor | 0.8 | psi |
| Fluidization Time on Intrusion | 2.0 | minutes |
| Air Storage Tank Refill after Fluidization | 2.0 | hours |
| Air Pressure Storage Tank Vol. | 18,000 | gal. of air |
| Air Pressure Storage Tank Pressure | 250 | psig |
| Air Blower Capacity on refill | 350 | scfm |
| Air Blowers Horsepower | 75 | hp |

Figure 9:
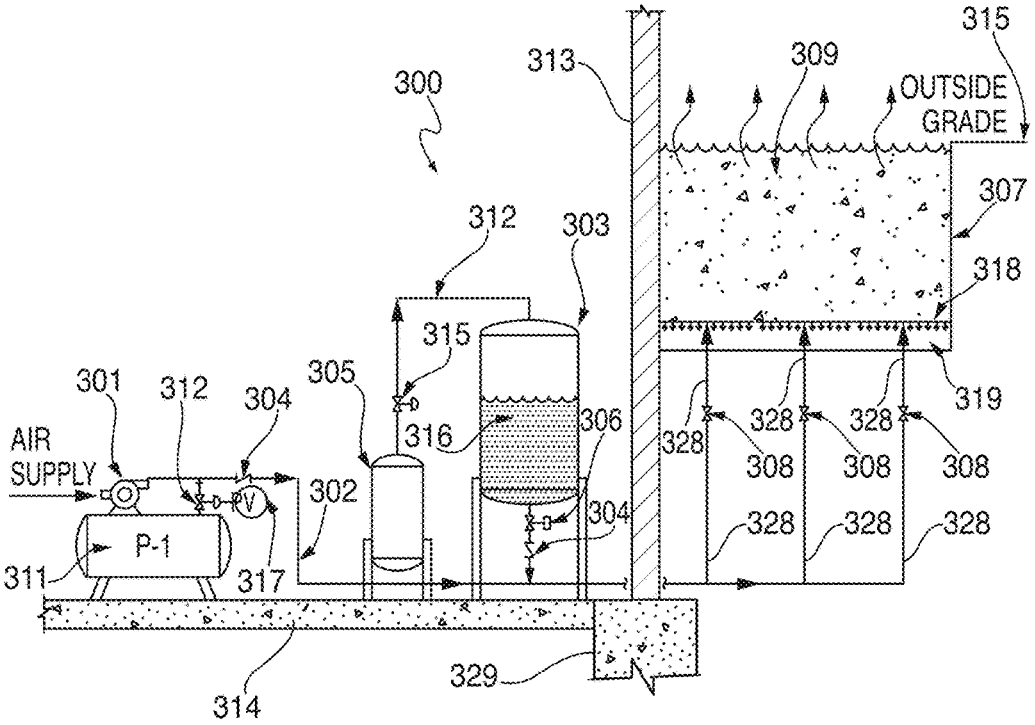
FIG. 9 is a tear gas enhanced fluid bed security system emitting tear gas when a fluid bed configuration in placed in a fluidized state.

With reference to FIG. 9, there is shown a CS tear gas enhanced fluid bed security apparatus 300. The effect of CS generally depends on the method of delivery. The concentration of CS, when delivered as a gas, or the size of the solution droplets, when delivered as an aerosol, influences the effect of CS. In a preferred embodiment, CS, which is solid at room temperature, is dissolved in an organic liquid solvent, such as methylene chloride, to produce a CS tear gas solution 316 that is housed in tank 303. When the tear gas solution 316 is metered into the fluidizing air flowing in line 302 for a 3% by volume of CS in the flowing air stream, the CS solution evaporates and becomes a stable aerosol fog in the flowing air stream. The solution is injected through a valve and fog nozzle 306 which yields the equivalent of a very dilute liquid, preferably in an aerosol state. In this state, the tear gas is uniformly diluted in the air stream as it leaves the fog nozzle 306.

When delivered as a gas at a defined concentration, such as 3% volume % CS in air, CS reacts with moisture on the skin and in the eyes causing a burning sensation and the immediate forceful and uncontrollable shutting of the eyes. A delivery method that causes higher concentrations or larger droplets causes burning and tearing of the eyes, profuse coughing, nasal mucus discharge, nose and throat irritation, disorientation, dizziness, shortness of breath and other uncomfortable reactions. In highly concentrated doses it can also induce vomiting. These effects are generally non-lethal in nature. Thus, the application of CS tear gas to a fluidized bed security system, which in many respects aims to reduce the rate of lethal events, is a suitable match. It should be appreciated that higher or lower concentrations of CS may be utilized while still keeping within the spirit and scope of the present invention.

Referring again to FIG. 9, a building basement section is shown with vertical wall 313. It should be appreciated that many embodiments may be created and implemented while keeping within the spirit and scope of the present invention, including the creation and implementation of the tear gas enabling portion of the system on the main level or at levels above. The application here, however, of the fluidizing gas and tear gas enabling portion are shown and positioned below the outside grade 315. The vertical wall of the building 313 is on footing section 329. The basement floor 314 completes the basement section of interest.

Outside the building is a fluid bed moat section comprising the tear gas enhanced fluidized bed protection system 300. System 300 can be positioned so that it encircles the entire building or is limited to a section of the building considered vulnerable to unauthorized entry by personnel or a vehicle equipped for a violent penetration of the building wall. When the fluid bed is not fluidized and in a defluidized state, the outside fluid bed is at grade level and personnel or vehicles can walk or drive on the defluidized moat.

In this embodiment, the fluid bed moat section comprises a walled container 307 and a distributor plate 318. The walled container 307 is filled to grade level with sand 309. Underneath the distributor plate 318, is a volume or plenum chamber 319 which is a receiver for the fluidizing gas. The source of fluidizing gas is a compressor 301, which keeps the pressure in tank 311 at a controlled elevated pressure by pumping the air through controller and indicator 317 and through check valve 304. Check valve 304 prevents reverse flow in line 302 which conveys the air to the three valves 308, 308, 308, which then feeds the air to the multiple sections of the plenum chamber 319.

This flow of air through feed pipes 328, 328, 328 fluidizes the sand volume surrounding the building being protected. Air fed through feed pipes 328, 328, 328 pressurizes the plenum volume 319 and the air is driven uniformly through the distributor plate 318 into the bed of sand. The fluidized sand behaves like a dry quicksand and any person or vehicle on the surface of the sand bed 309 is immediately partially submerged in the sand bed to a level of three or four feet. If the bed is defluidized after submergence the person or vehicle is trapped in the bed and could only escape with the aid of the proper authorities re-fluidizing the bed to enable removal with a winch for the vehicle or a short ladder for the person.

In the event the intrusion involves penetration of the building wall and/or an unruly crowd forms outside of the building, the threatening crowd could be controlled by another signal and within about 15 seconds the mechanism for emitting tear gas is activated and CS gas starts flowing. In a preferred embodiment, the CS tear gas is provided in a solution of CS and methylene chloride solvent 316 held in tank 303 which is maintained by pressurized nitrogen gas in the free board provided from nitrogen cylinder 305 at a pressure of 8 psig through pressure regulator 315 and line 312 to tank 303. The flow rate of the solution of CS in methylene chloride is fed at a prescribed flow rate through flow control valve 306. The CS solvent enters the fluidized gas line 302 and mixes through with air flowing in fluidizing feed line 302. The check valve 304 ensures that no air from line 302 can back flow into tank 303. The flow rate of CS in solution is adjusted by flow control valve 306 such that the resulting concentration of CS flowing in line 302 to the inlet valves 308 is approximately 3% CS in this feed line. This rate of flow of CS is precalculated from the known air flow rate of air in line 302 coming from tank P-1 311. The check valve 312 ensures that there cannot be any chance that the CS solution gas can reach tank 311.

Significantly, the concentration of CS gas fed to the fluid bed is controlled by regulating the concentration of CS gas in the methylene chloride solvent, the flow rate of solvent mix and the flow rate of air from tank 311. These controlling and setting values for the concentration of CS gas-methylene chloride solvent mix, the flow rate of the solvent mix and the known air flow rate from tank 311 results in the ability to control the ultimate concentration CS gas being disseminated through the fluid bed at an optimum required level. With the concentration of CS gas controlled carefully there is virtually no possibility of overconcentration in the surrounding affected area and this action is less than lethal, as desired. Among the benefits of helping disperse an unruly assembly, applying a CS tear gas in this manner may also provide important time needed to delay entrance by those who are more determined (and/or better equipped) to enter a secured location. The tear gas enhancement, can be operatively connected by those of ordinary skill in the art to (and selectively disconnected from) many fluid bed configurations, in addition to the fluid bed moat units shown in FIG. 7 and FIG. 8 as well as the fluid beds depicted in preceding figures.

Figure 10:
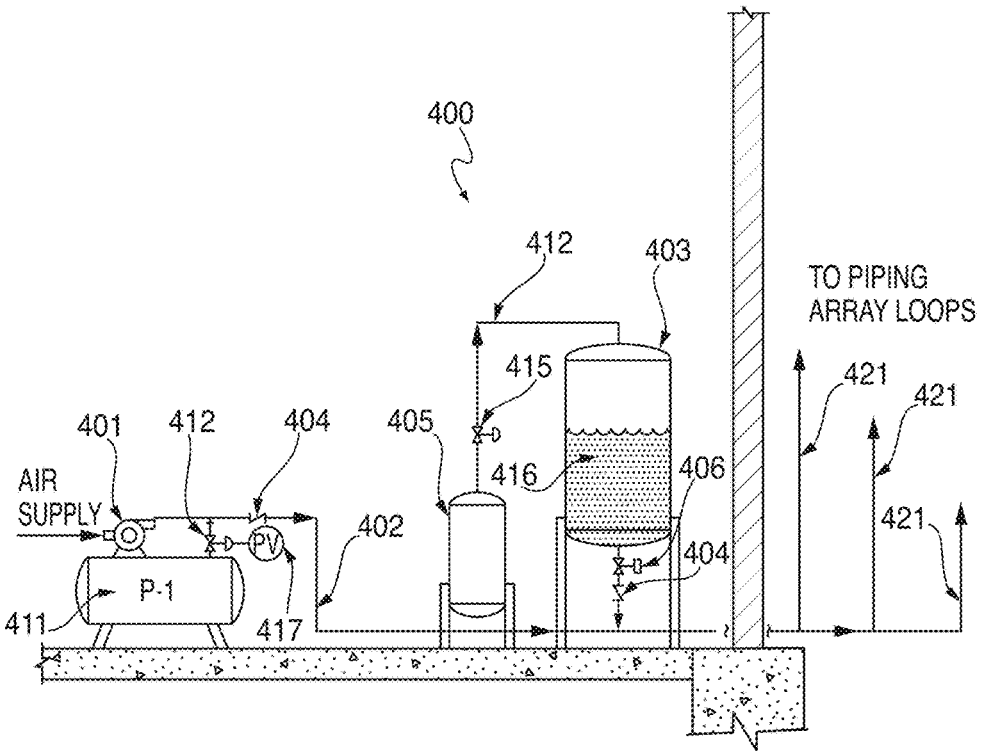
FIG. 10 is a tear gas delivery system for tear gas via a piping distribution array without a fluid bed configuration.
Figure 11:
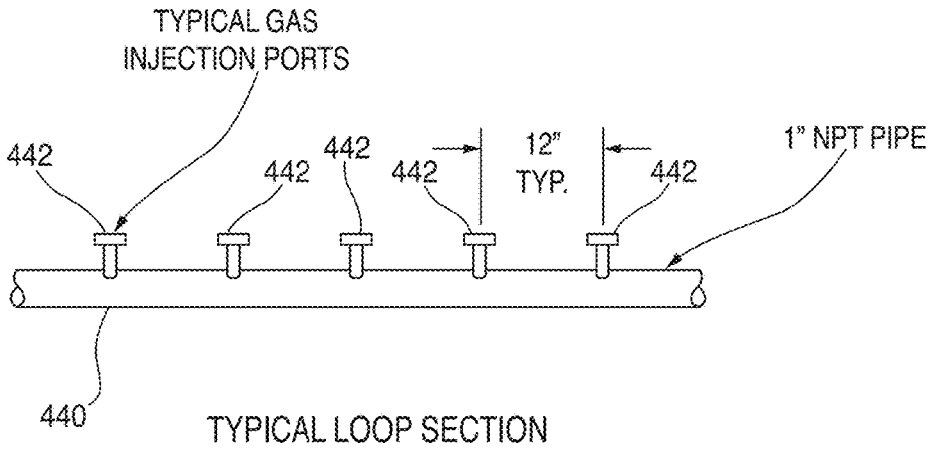
FIG. 11 is a loop section for distributing tear gas.
Figure 12:
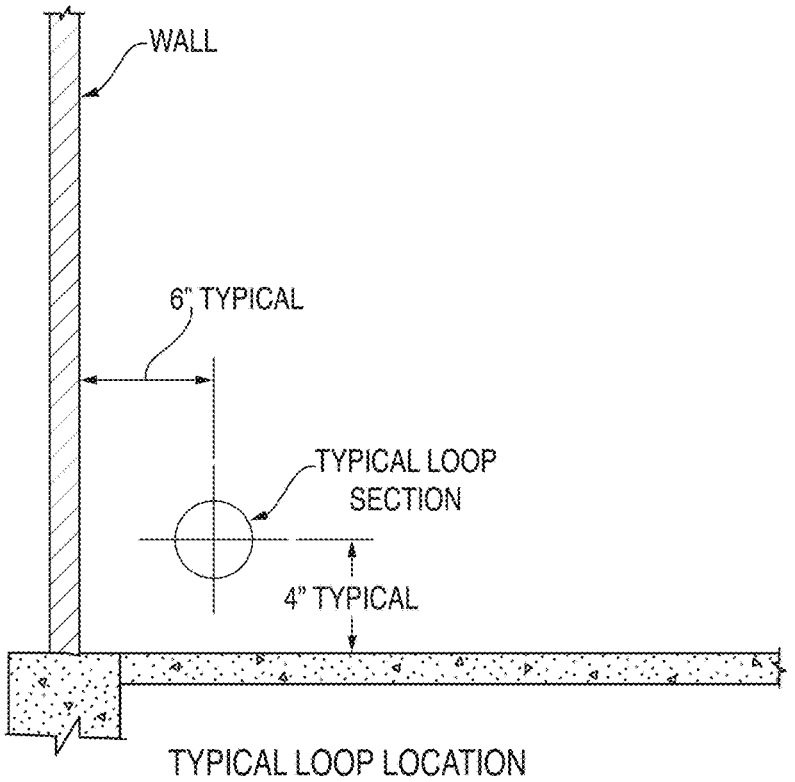
FIG. 12 displays the preferred loop location for distributing tear gas.

With reference to FIG. 10, FIG. 11 and FIG. 12, there are certain instances where a fluid bed configuration or module is not feasible. For example, where the geometric details of a building being protected are not suitable for fluid bed moat arrangement surrounding the building, or the particular details of the aggressive attack may be via a tortuous path that is not suited for installation of a fluid bed moat arrangement, it may not be practical to install a fluid bed system. However, under many of these circumstances, it may yet be worthwhile to have a tear gas delivery system in accordance with the present invention which can provide protection against individuals or a hostile assembly utilizing important aspects of the arrangement set forth in FIG. 9, with some alterations thereto.

Accordingly as depicted in FIG. 10, FIG. 11 and FIG. 12, there is a CS tear gas supply system 400 for the reliable, concentration-controlled delivery of CS tear gas. In a preferred embodiment, the CS tear gas is provided in a solution of CS and methylene chloride solvent 416 held in tank 403 which is fed by pressurized nitrogen gas from nitrogen cylinder 405 through pressure regulator 415 and line 412 to tank 403. Maintenance at a given pressure is typically 6 psig and control valve 406 in the discharge from tank 403 is opened to feed at a preset controlled rate. The CS in solvent enters the fluidizing gas line 402 and mixes thoroughly with the air coming from check valve 404. The check valve 412 ensures that there cannot be any chance that the CS solution gas can reach tank 411. In a system operating on CS tear gas only (i.e., with no fluidized bed moat), it is not necessary to supply a 18,000 gallon high pressure tank nor a high pressure blower as is preferred in connection with a combined CS tear gas and fluid bed moat configuration. In a system operating on CS tear gas only, it is preferred to utilize only a small surge tank 411 with a 6 HP blower 401 which blows air through controller and indicator 417 and through check valve 404. Check valve 404 prevents reverse flow in line 402 which conveys the air to the three paths 421, as noted below. Thus, while the facilities for air supply may be different, the concentration control of the tear gas, and the flow rate of optimum tear gas concentrations are generally the same as disclosed in connection with system 300 presented in FIG. 9.

Aside from the difference in air supply, the primary difference between system 300 and system 400 is that the gas feed does not feed into a plenum chamber 319 for fluidizing sand particles. Instead, gas is fed into piping array loops 440, an example of which is depicted in FIG. 11, along N paths 421 (three are shown in FIG. 10) at an air pressure of approximately 6 psig and containing approximately 3% by volume CS. More or fewer distribution loops may be used as needed to feed the tear gas to a given area (e.g., rooms, corridors or outside areas). In a preferred embodiment, the CS tear gas is distributed via gas nozzles 442 spaced approximately 12 inches apart on the top side of the pipes, as shown in FIG. 11. In a most preferred embodiment, the preferred location for placement of a piping array for distribution of CS tear gas without a fluid bed arrangement is along corridors near corners formed by the floor and walls of each room, as shown in FIG. 12. However, it should be understood that the piping array may be distributed and positioned as desired in exterior areas as well.

Utilizing the configuration and system specified above, the flow of CS tear gas commences within approximately 3 minutes of initiation of an actuation signal, whether based on the observed potential aggressive mob intrusion or otherwise. In a most preferred embodiment, sufficient CS tear gas supply should be available for at least an hour to allow sufficient time for authorities or help to arrive.

The accompanying drawings only illustrate a preferred embodiments of a tear gas enhanced fluidized bed security system and method, its constituent parts, and method of use. However, other types and configurations are possible, and the drawings are not intended to be limiting in that regard. Thus, although the description above and accompanying drawings contains much specificity, the details provided should not be construed as limiting the scope of the embodiment(s) but merely as providing illustrations of some of the presently preferred embodiment(s). The drawings and the description are not to be taken as restrictive on the scope of the embodiment(s) and are understood as broad and general teachings in accordance with the present invention. While the present embodiment(s) of the invention have been described using specific terms, such description is for present illustrative purposes only, and it is to be understood that modifications and variations to such embodiments, including but not limited to the substitutions of equivalent features, materials, or parts, and the reversal of various features thereof, may be practiced by those of ordinary skill in the art without departing from the spirit and scope of the invention. It should also be noted that the terms "first," "second" and similar terms may be used herein to modify various elements. These modifiers do not imply a spatial, sequential, or hierarchical order to the modified elements unless specifically stated.

The invention claimed is:

1. A tear gas enhanced fluid bed security system comprising:

a fluid bed having an enclosure within which a plurality of fluidizable granular solids is disposed;

a gas fluidizer;

a plurality of lines, said lines supplying fluidizing air from said gas fluidizer to said plurality of fluidizable granular solids; and a first tank comprising a tear gas solution comprised of 2-chlorobenzalmalononitride (CS) and a methylene chloride solvent, said tank being fluidly connected to said plurality of lines supplying fluidizing air;

wherein when said gas fluidizer is activated, said air and said tear gas solution is supplied together to said plurality of lines to disperse said tear gas solution through said fluid bed.

2. The system of claim 1, further comprising an air blower, operatively connected to said plurality of lines.

3. The system of claim 2, wherein said tear gas solution is dispersed out of said fluid bed in a concentration of 3%.

4. The system of claim 1, wherein said gas fluidizer comprises a high pressure tank sufficient for supplying rapid fluidization of said fluidizable granular solids in said fluid bed in approximately 3 seconds.

5. The system of claim 4, wherein said gas fluidizer further comprises a low pressure compressor to continue fluidization for an extended period of time after gas in said high pressure tank is exhausted.

6. The system of claim 5, wherein said low pressure compressor is sufficiently sized to continue fluidization for an hour or longer to continue supplying said tear gas solution through said fluid bed.

7. The system of claim 1, wherein said a fluid bed comprises a plenum chamber, said plenum chamber receiving gas beneath said fluidizable granular solids when said gas fluidizer is activated.

8. The system of claim 7 further comprising a distributor plate positioned above said plenum chamber for distributing said fluidizing air to said plurality of fluidizable granular solids.

9. The system of claim 1 further comprising a second tank, said second tank holding nitrogen and being fluidly connected to supply nitrogen to said first tank comprising said tear gas solution.

10. The system of claim 1, wherein said tear gas solution is fed from said first tank to said plurality of lines at a prescribed flow rate through a flow control valve.

11. The system of claim 10, wherein upon exit from said first tank, said tear gas solution mixes with said fluidizing air flowing in said lines.

12. The system of claim 10, further comprising a check valve along said plurality of lines to prevent back flow of tear gas solution to said gas fluidizer.

13. The system of claim 1, wherein when tear gas solution is fed to said plurality of lines through a fog nozzle, said tear gas solution is uniformly diluted in said fluidizing air in said plurality of lines.

14. The system of claim 1, wherein the concentration of CS gas fed to the fluid bed is controlled by regulating the concentration of CS gas present in the methylene chloride solvent, the flow rate of tear gas solution fed to said plurality of lines and a flow rate of fluidizing air.

15. The system of claim 1, wherein said fluid bed is a modular fluid bed.

16. The system of claim 15, wherein said modular fluid bed is approximately 20 feet in width by 50 feet in length.

17. A tear gas delivery system for supplying a reliably controlled concentration of tear gas, comprising:

an air blower;

a supply line having a gas distribution array, said supply line being attached to said air blower;

a surge tank fluidly connected to said air blower and said supply line;

a first tank, said first tank holding tear gas solution comprised of a mix of 2-chlorobenzalmalononitride (CS) and a methylene chloride solvent, said tank being fluidly connected to said supply line;

a second tank, said second tank holding nitrogen and being fluidly connected to supply nitrogen to said first tank holding said tear gas solution wherein when said air blower is activated, said tear gas solution is released into said supply line for mixing with air and said tear gas solution is supplied via said gas distribution array for dispersion of said tear gas solution.

18. The delivery system of claim 17, wherein said air blower is a low pressure air blower.

19. A method of reliably delivering a controlled concentration of tear gas to deal with hostile assemblies in a non-lethal manner, comprising the steps of:

providing a fluid bed enclosure having an open perimeter;

providing a plurality of fluidizable granular solids disposed in said fluid bed enclosure;

providing a gas distribution array leading to said first enclosure;

providing a gas fluidizer and connecting said gas fluidizer via a line to said gas distribution array;

providing a first container with tear gas solution fluidly connected via said line to said gas distribution array;

fluidizing the fluid bed enclosure by activating said gas fluidizer; and releasing said tear gas solution in said line for delivery to said fluid bed enclosure in a concentration that is below a lethal level;

wherein when said fluid bed enclosure is fluidized, said tear gas solution enters said line and is dispersed through and above said fluidizable granular solids when said fluidizable granular solids are fluidized.

20. The method of claim 19, wherein said releasing step further comprises feeding said tear gas solution to said line through a fog nozzle such that said tear gas solution is uniformly diluted in said line.

* * * * *